US006036837A

United States Patent [19]

Nau et al.

[11] Patent Number: 6,036,837

[45] Date of Patent: Mar. 14, 2000

[54] PROCESS AND MACHINE FOR PARTIALLY PLATING TEST PROBES

[75] Inventors: Dennis B. Nau, Gibbon; Jeffrey J. Bellm, New Ulm, both of Minn.

[73] Assignee: Celex, Incorporated, Gibbon, Minn.

[21] Appl. No.: 09/184,421

[22] Filed: Nov. 2, 1998

[51] Int. Cl.[7] ..... C25D 5/02

[52] U.S. Cl. ..... 205/128; 205/148; 204/222; 204/273

[58] Field of Search ..... 204/297 R, 279, 204/273, 222

[56] References Cited

U.S. PATENT DOCUMENTS

| | | | |
|---|---|---|---|
| 1,079,427 | 11/1913 | Murphy | 204/202 |
| 1,335,177 | 3/1920 | Merritt | 205/73 |
| 2,721,834 | 10/1955 | Koury | 204/23 |
| 3,275,542 | 9/1966 | Couture | 204/222 |
| 3,276,986 | 10/1966 | Swistun | 204/224 |
| 3,397,126 | 8/1968 | Gilbert | 204/23 |
| 3,616,281 | 10/1971 | Head et al. | 204/15 |
| 3,804,732 | 4/1974 | Goodkin | 204/58 |
| 4,312,716 | 1/1982 | Maschler et al. | 204/15 |
| 4,359,366 | 11/1982 | Eidschun | 204/15 |
| 4,364,801 | 12/1982 | Salama | 204/15 |
| 4,399,019 | 8/1983 | Kruper et al. | 204/212 |
| 4,497,693 | 2/1985 | Ogura et al. | 204/15 |
| 5,200,048 | 4/1993 | Tanaka et al. | 204/297 R |
| 5,217,536 | 6/1993 | Matsumura et al. | 118/602 |
| 5,726,361 | 3/1998 | Ogawa | 73/663 |

FOREIGN PATENT DOCUMENTS 2259523A 3/1993 United Kingdom .

*Primary Examiner*—Kathryn Gorgos
*Assistant Examiner*—Erica Smith-Hicks
*Attorney, Agent, or Firm*—Edwin E. Voigt II; Vidas, Arrett & Steinkraus

[57] ABSTRACT

A method and two-part plating apparatus for plating groups of elongated objects. The plating apparatus includes a fixture and a fixture support. The fixture is configured to loosely retain a group of elongated articles in a generally vertical orientation where the upper ends are contained within a cavity and the lower ends are in contact with a support surface. The cavity includes an electrode which is electrically connected to the upper ends of the elongated articles. The fixture is configured to be placed onto and partially through a fixture support which is in contact with a container of plating solution. The fixture support has a base and an agitation element which moves the fixture with respect to the base, thus shifting and exposing surfaces of the elongated articles to facilitate plating.

27 Claims, 5 Drawing Sheets

PROCESS AND MACHINE FOR PARTIALLY PLATING TEST PROBES

BACKGROUND OF THE INVENTION

This apparatus and process involves the plating of one end of cut, straightened wires typically used as probe needle blanks for quality assurance testing of computer chips and other integrated circuits. These blanks are typically made of a tungsten or rhenium-tungsten alloy and the plating is typically a nickel electroplating, but other alloys and plating material could be used as well.

In the industry today, one end of these wires is nickel plated for solderability (solder will not stick to unplated tungsten). The other end cannot be plated, since it is electrochemically etched to a point. The current practice involves loading these probe needle blanks into a fixture where individual electrical contact is made and lowering them into a plating solution or bath to the desired depth of plating. The power supply is then turned on, supplying power to the individual probes and to the plating anode, and the plating process commences. The drawback of this process is simply the time and labor involved. Each needle blank must be handled individually in the loading and unloading process. Typically, 30 or 40 pieces are plated at once.

The present invention and process enables plating to be performed in lots of thousands at a time. It can naturally be done much less expensively. The process has several distinguishing characteristics.

A group of parts are dropped into a specially designed fixture (a group being hundreds to thousands of parts depending on the size of the fixture and the diameter of the parts). The fixture consists of a number of unique components (see FIG. 1).

The pressurized gas supply is used to keep the upper cap free of the plating solution. Air pressure is not needed if the rate of plating is fast enough to cause enough hydrogen gas to evolve to collect in the cap.

The hole in the middle plate should be no larger than the hole in the cap and should be positioned closer to the bottom plate. This will allow the parts to move freely when the fixture is put in motion.

Another unique feature of this apparatus is the motion imparted to it. This motion can be imparted by two linear actuators mounted horizontally at right angles to each other, and synchronized. It also can be done rather simply by an offset cam, in a spring-loaded fixture (see FIG. 2).

The purpose of this oscillating type of motion will be to impart some centrifugal force to the parts which will tend to keep them in intimate contact with the cap, thereby assuring that electrical contact will be maintained. It will also assure that parts will lean in one direction and then another direction, thereby making certain that there is relative movement between the parts. This will assure even coverage over the surface in the plating operation and prevent the parts from plating together.

In order to assure even distribution of the plating over the entire surface to be plated, good general plating practices must be followed, including shielding the anodes to "break up" the lines of force, maintaining proper temperature and pH, keeping the plating solution clean, etc.

THE PRIOR ART

U.S. Pat. No. 3,275,542, issued to Couture on Sep. 27, 1966, teaches the use of an apparatus for electroplating leads of small electronic components and particularly to the tinning of slender leads of small glass diodes. This patent teaches the use of a very large number of diodes in the several thousands which are leaded into a conductive perforate tray which is a relatively flat basket having an open top which is formed of stainless steel mesh material. This patent teaches the use of cleansing of the diodes through the use of a suitable acidic solution wherein the basket is transferred for use in plating. The basket is then immersed in electrolyte and given a short rectilinear reciprocation horizontally to agitate the diodes so the leads may make electrical contact with one another within the basket which also serves to stir the electrolyte.

U.S. Pat. No. 3,276,986, issued to Swistun on Oct. 4, 1966, teaches the use of an electrolytic apparatus for treatment of the tips of glass beaded leads and copper sheathed leads for glass-enclosed diodes. This patent further teaches the use of an apparatus including a cup which is frusto-conical in configuration where the cup is conductive but non-magnetic. The cup is designed to function as a container carrying a large number of glass-beaded leads. The container transfers approximately 400 leads from the container to the cup during use of the apparatus. The apparatus includes a vibrator unit for leveling of the leads. The frusto-conical shape of the cup avoids the criss-crossing of the leads and further causes them to fan outwardly so that the beaded upper end of the diodes lie in a plane which is slightly convex. A magnet assembly is applied to the cup where the assembly of the cup and magnet as carrying the leads is inverted over a tank containing an electrolyte. During plating, the cup is negatively charged and the electrode is positively charged.

U.S. Pat. No. 3,397,126, issued to Gilbert on Aug. 13, 1968, teaches the use of an apparatus for plating small parts where the small parts are distributed on a substantially horizontal plate-like holder held in an electrolytic bath where electrode means are provided for contacting the parts and continuously vibrating the holder to continuously change the position of the parts with respect to the holder and with respect to each other while electrolytically treating the same.

U.S. Pat. No. 3,616,281, issued to Head et al. on Oct. 26, 1971, teaches partially plating reeds in bulk, the reeds of the type having a shank and a blade. The reeds are loosely retained in insulating pots so that the blades extend beyond the rims of the pots. The rim and the base of the pots are metalicized and with the reeds form a cathode of the plating surface. During plating, the shafts of the reeds are screened from the plating flow by the insulating side walls of the pots, thereby plating the blades. To facilitate uniform plating the pots are subjected to high-speed orbital movement, which exposes the blade surfaces to the plating solution.

The problem with the above-mentioned plating devices is that they are unable to plate lower portions of a group of loosely contained, elongated articles while a plating portion of a fixture is submerged or partially submerged in an electrolytic solution.

There is a need for a device which can be used to selectively plate large quantities of elongated articles in bulk.

SUMMARY OF THE INVENTION

A plating method and apparatus for depositing metal on a plurality of elongated articles. The apparatus comprises a fixture support and a fixture. The fixture support includes an agitation element with an aperture. A driver is operatively connected to and capable of moving the agitation element. The fixture comprises a support portion and a plating portion. The support portion has a positioning element which is connectable to the agitation element and which is connected to the plating portion by a support member. The plating portion includes a top portion having a cavity configured to receive a plurality of elongated article ends and a bottom portion spaced apart from and configured to support a plurality of elongated article ends. In operation, a plurality of elongated articles are retained between the top and bottom portions of the fixture. The fixture is then positioned on the fixture support so that the positioning element is connected to the agitating element. The driver then moves the agitation element and fixture to facilitate the plating process.

In one embodiment of the plating apparatus, the fixture comprising the support portion and the plating portion are attached to the support member to enable the entire fixture to be moved as a unit.

In a second embodiment, the top portion of the fixture is attached to a second support member which is movable relative to the support portion.

A principal object of the present invention is to plate a plurality of elongated articles in bulk.

Another object of the present invention is to facilitate plating of a plurality elongated articles by moving the plurality of elongated articles within the confines of a fixture.

Another object of the present invention is to prevent plating of selected ends of elongated articles by forming non-plating zones.

Yet another object of the present invention is to provide a simple electrical connection for groups of elongated articles.

Still another object of the present invention is to increase the ability to plate groups of differently sized elongated articles.

Another object of the present invention is to simplify construction and promote interchangeability of parts.

A feature of the present invention is a fixture which is attachable to a fixture support. The fixture is configured to loosely hold a plurality or group of elongated articles, such as test probes, in a generally vertical orientation.

Another feature of the present invention is that a top portion of the fixture includes a downwardly facing cavity which is provided with an electrically conductive surface.

Yet another feature of the present invention is that the cavity defines a non-plating zone into which upper ends of a group of elongated articles project.

Still another feature of the present invention is that nonconductive fluid may be introduced into the cavity to vary the non-plating zone size.

Another feature is that the fixture may be adjusted to accommodate groups of different lengths of elongated articles.

Another feature of the present invention is that the fixture support includes an agitation element which is used to move the fixture.

Still another feature of the present invention is that the fixture support is provided with index pins onto which the fixture is positioned.

An advantage of the present invention is that large groups of elongated articles, such as slender test probes, may be plated at the same time.

Another advantage is that the fixture may be configured to loosely retain different lengths of groups of elongated articles.

Yet another advantage is that a plurality of differently sized fixtures may be utilized with one fixture support.

These, and other objects, features and advantages of the invention will become more readily apparent to those skilled in the art from the detailed description and the accompanying drawings.

DETAILED DESCRIPTION

Figure 1:
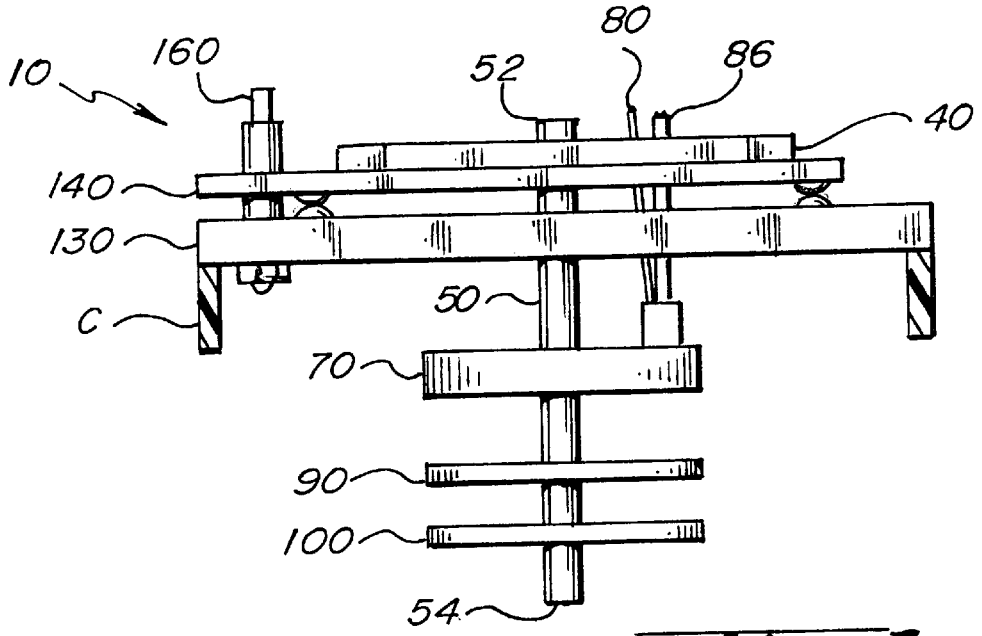
FIG. 1 is a partial plan view of a plating apparatus of the present invention in the assembled state, where a fixture is connected to a fixture support and where posts and retainers which attach portions of an agitating element to a base of the fixture support have been omitted for ease of viewing.
Figure 3:
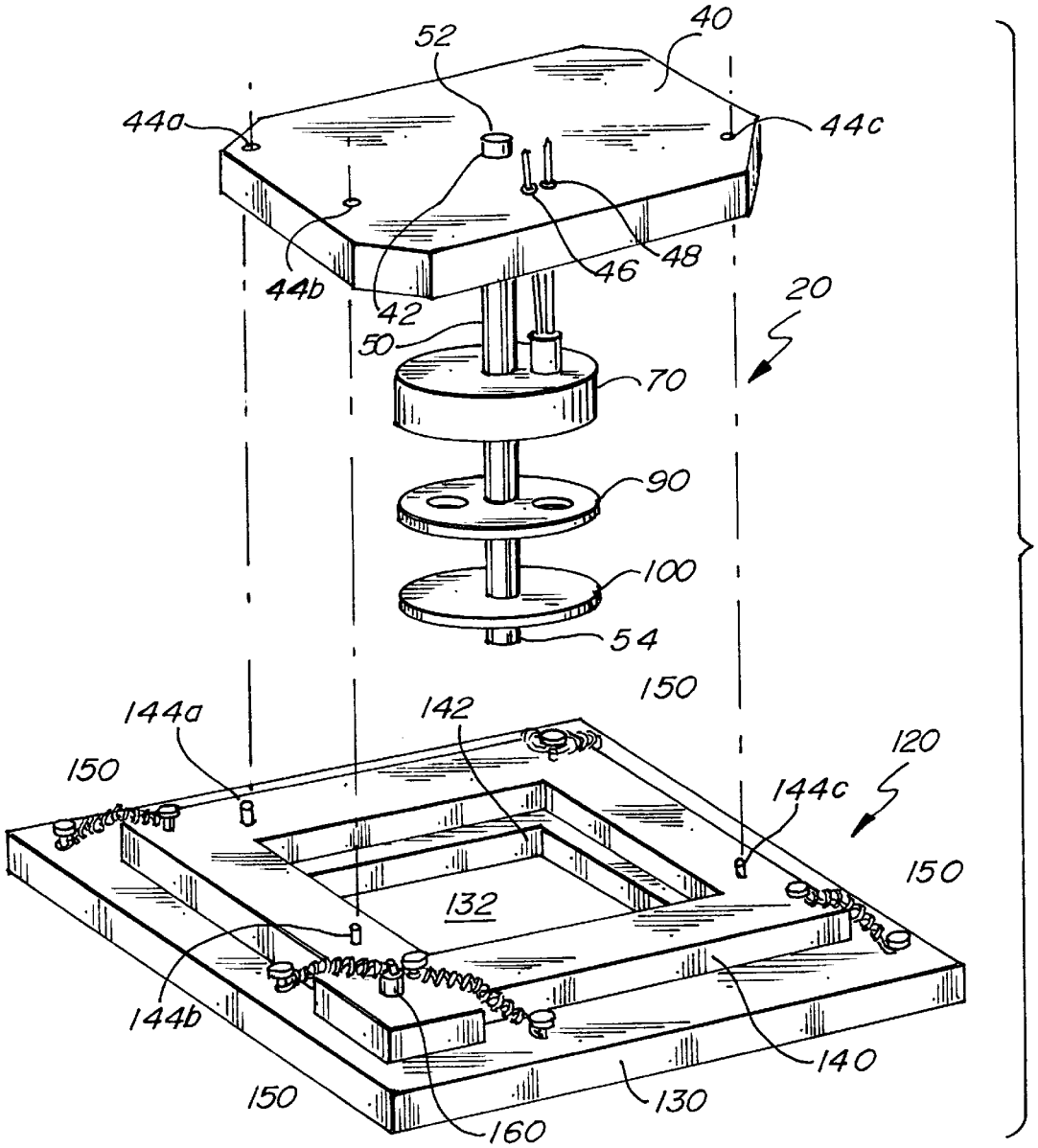
FIG. 3 is an exploded, perspective view of the fixture and the fixture support of the present invention, prior to assembly as depicted in FIG. 1.

Referring to FIGS. 1 and 3, the plating apparatus is shown and generally designated with the numeral 10. Plating apparatus 10 comprises a fixture 20 and a fixture support 120. Fixture support 120 comprises a base 130 which rests upon container "C," and an agitation element 140. As will be discussed later, agitation element 140 is movable relative to base 130 by a driver 160.

The second part of the plating apparatus, the fixture 20 comprises a positioning element 40 onto which a support member 50 having first and second ends 52, 54, respectively is attached. This attachment is accomplished by providing positioning element 40 with a through hole 42 which is sized to frictionally receive a first end 52 of support member 50, and wherein support member 50 projects away from positioning element 40 in a downwardly direction to form a support portion 30 (see FIG. 6). Continuing in the direction from the first end 52 to the second end 54 are three portions which form a plating portion 60 (see FIG. 6) of the fixture 20. The first portion, the top portion 70 is spaced from the positioning element 40 by an appropriate distance to enable plating to occur. Top portion 70 is provided with a through hole 72 (see FIG. 7) which is sized to frictionally receive support member 50. Spaced from, and in registry therewith, is a middle portion 90. As will be discussed later, middle portion 90 includes apertures which correspond to cavities in top portion 70. Continuing toward second end 54 of support member 50, the third portion is the bottom portion 100. Bottom portion 100 is spaced from and in registry with middle portion 90. Bottom portion 100 is provided with through hole 102 (see FIG. 7) which frictionally receives support member 50.

Figure 2:
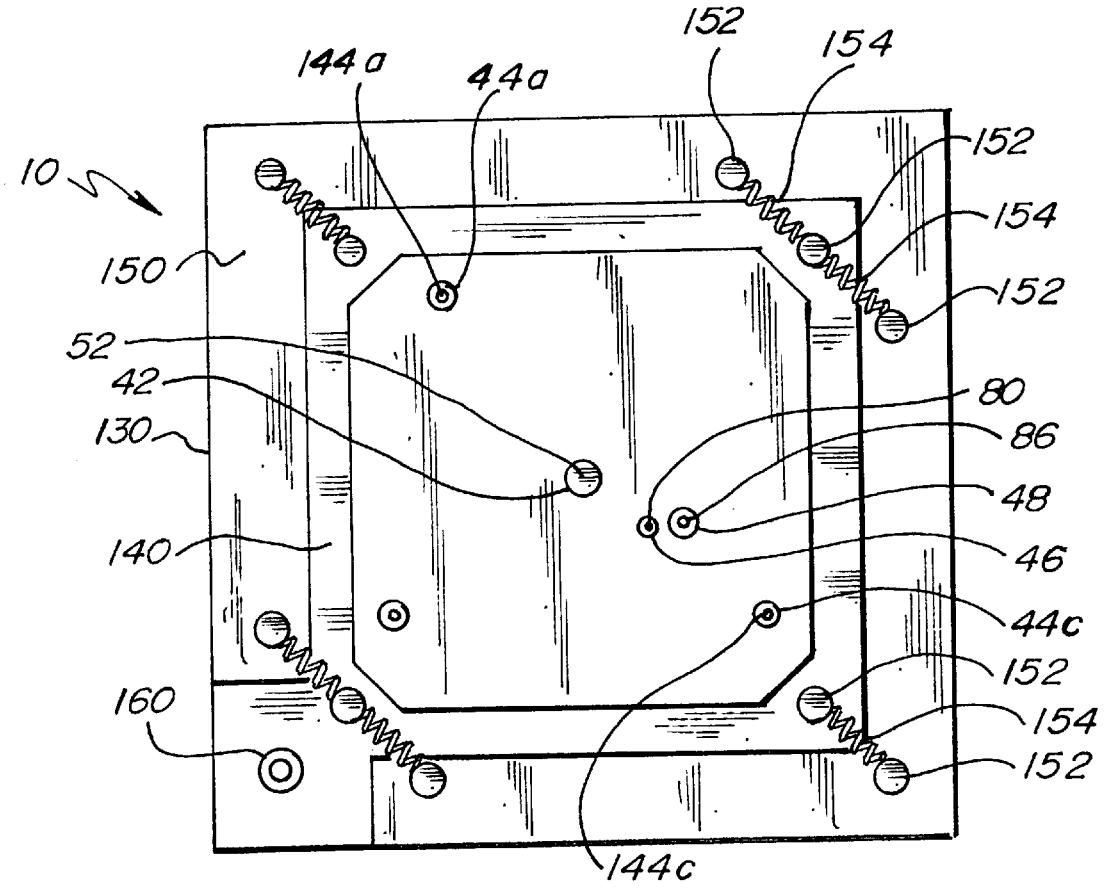
FIG. 2 is a top view of the plating apparatus in which the posts and retainers which attach portions of the agitating element to the base are depicted.

Referring to FIGS. 2, positioning element 40 rests on agitation element 140 and is connected thereto by index pins 144A, 144B, 144C which project upwardly from agitation element 140 and are received in through holes 44A, 44B, 44C in positioning element 40. Positioning element 40 also includes apertures 46, 48 through which are sized to passingly receive a wire and a conduit 80, 86, respectively.

As can be seen, agitation element 140 is attached to base 130 by a plurality of retainers 150, the retainers 150 located equidistantly from each other about the perimeter of agitation element 140. Retainers 150 comprise a plurality of posts 152 and spring elements 154. The posts 154 are attached to base 130 and agitation element 140 and the spring elements 154 are attached to the posts 152. While spring elements 154 are attached via posts 152, it is understood that attachments can be used without departing from the spirit and scope of the invention. For example, spring elements may be attached directly to base 130 and agitation element 140.

Referring to FIG. 3, fixture 20 is attached to fixture support 120 by aligning index pins 144A, 144B, 144C of agitation element 140 with through holes 44A, 44B, 44C of positioning element 40. As fixture 20 is attached to fixture support 120 the lower plating portion 60 of fixture 20 passes through apertures 142, 132 and into a plating solution (see FIG. 6). As can be appreciated, second end 54 of support member 50 may be inserted into through hole 42 of positioning element 40 so that fixture 20 is supported from below rather from above, without departing from the spirit and scope of the invention.

Figure 4:
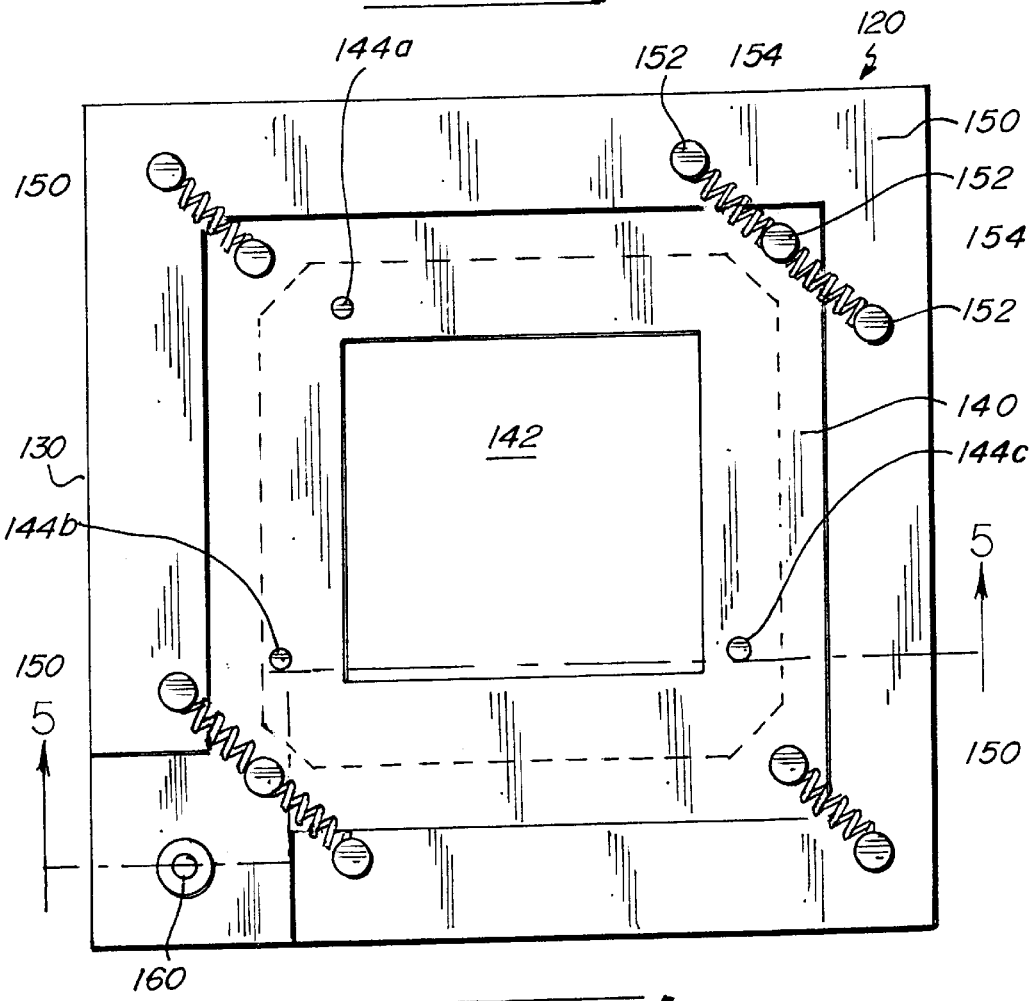
FIG. 4 is a top plan view of the fixture support of the present invention with the outline of the fixture in dashed lines.

Referring to FIG. 4, fixture support 120 is shown with the outline of fixture 20 in dashed lines. Here, as in FIG. 2, agitation element 140 is attached to base 130 by a plurality of retainers 150, the retainers 150 located equidistantly from each other about the perimeter of agitation element 140. Retainers 150 comprise a plurality of posts 152 and spring elements 154. The posts 154 are attached to base 130 and agitation element 140 and the spring elements 154 are attached to the posts 152. As can be seen, aperture 142 of agitation element 140 is of sufficient size to admit the plating portion of fixture (not shown). Aperture 142 is coincident with aperture 132 of base 130 and is, therefore, not depicted in the figure. Although apertures 132, 142 are sized the same, it is understood that they may be of different sizes without departing from the spirit and scope of the invention.

Figure 5:
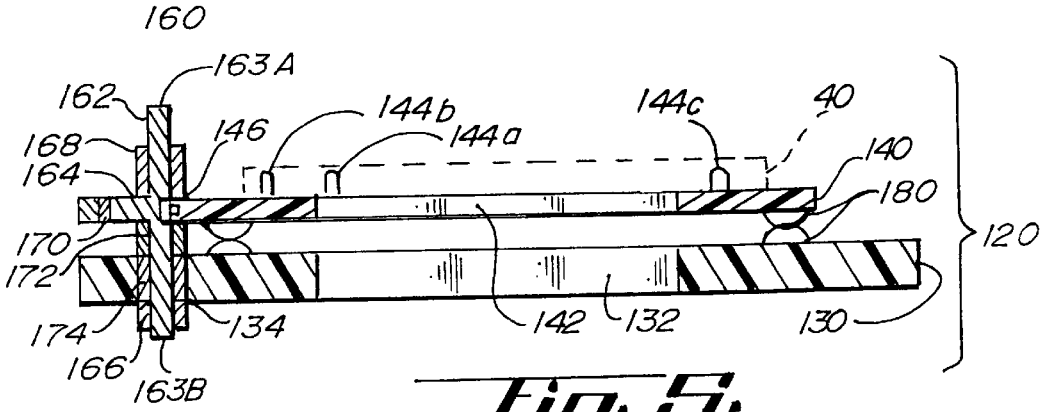
FIG. 5 is a partial, cross-sectional view of the fixture support taken along line A—A of FIG. 4 showing a driver for the agitating element.

Referring to FIG. 5, positioning element 40 of fixture 20 (shown in dashed lines) is depicted in operational position on fixture support 120. Motion to agitation element 140 is achieved by driver 160. Driver 160 comprises a shaft 162 with first and second ends 163A, 163B. A portion of shaft 162 is provided with a crank 164 which is used to provide motion to agitation element 140. Second end 163B of shaft 162 is inserted into through hole 134 of base 130, while first end 163A is inserted into through hole 146 of agitation element 140 so that crank 164 is in the same plane as agitation element 140. Shaft 162 is rotatable with respect to base 130 and agitation element 140, and if desired, bearings 170, 174 may be provided to reduce friction and heat generated by rotation thereof. As depicted, base 130 and agitating element 140 are provided with friction reducing elements 180 which are spaced in confronting relation between base 130 and agitation element 140. Friction reducing elements 180 may be made of poly-tetrafluorethylene, or other similar low-friction material. When friction reducing elements are used, it is preferred that a spacer/bearing 172 of similar thickness be placed between base 130 and agitation element 140. When assembled together, base 130 is connected to agitation element 140 by collar 168 and nut 166 which attach to first and second ends 163A, 163B of shaft 162 in a conventional manner. Additional attachment is provided by the spring elements 154 of retainers 150 which are under tension (not shown). Motion of agitation element 140 relative to base 130 occurs upon rotation of driver 160. As driver 160 rotates, crank 164 rotates. Crank 164 is offset from the longitudinal axis of shaft. Thus, as shaft 162 is rotated, agitation element 140 which is rotatingly connected to crank 164 moves relative to base 130. The motion imparted to agitation element 140 is generally circular, or orbital, and may be changed by providing cranks with different throws and configurations. Driver 160 may be rotated by an appropriate motive source such as a motor or a hand crank.

Although the driver of the preferred embodiment produces orbital motion by rotating a shaft with a crank, it is understood that motion need not be orbital. All that is required is that there be enough motion or acceleration to cause the group of loosely held elongated articles to move in response to centrifugal force. Thus, motion may be provided by linear actuation along one planar axis, or linear actuation along another planar axis, or a combination of linear actuations along orthogonal axes. The motion may be produced by appropriately selected motors, actuators, and linkages.

Additionally, it is understood that lubricants may be used in lieu of the friction reducing elements described above. When lubricants are used, the space between the base and agitation element will be reduced and the thickness of the spacer/bearing should be adjusted accordingly, or even omitted.

Figure 6:
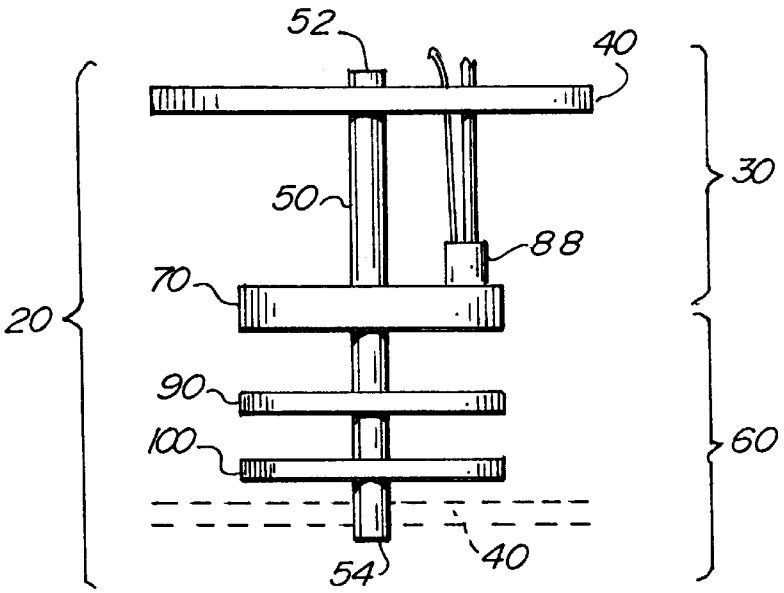
FIG. 6 is a side view of the fixture of the present invention.

Referring to FIG. 6, as mentioned above, fixture 20 comprises two parts, a support portion 30 and a plating portion 60. Although positioning element 40 is depicted as attached adjacent first end 52 of support member 50, it is understood that positioning element 40 may be attached adjacent second end 54, if desired (shown in dashed lines). When the positioning element 40 is attached adjacent the second end 54, motion may be provided as described above. Additionally, a rocking or gyrational type motion relative to a horizontal plane may be provided so that the ends of a group of elongated articles may move within the cavity of the top portion (not shown).

Figure 7:
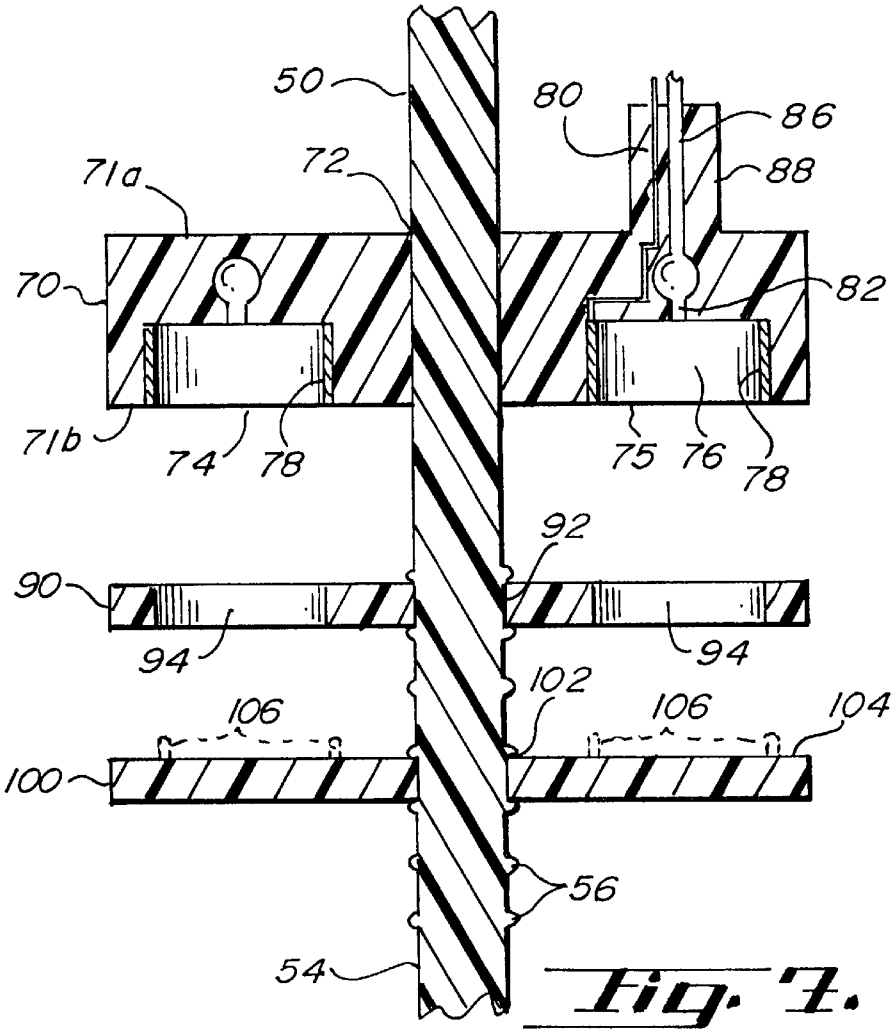
FIG. 7 is a partial, detailed, cross-sectional view of the fixture of the present invention where a positioning element has been omitted for clarity.

Referring to FIG. 7, plating portion 60 of fixture 20 features three portions, a top portion 70, a middle portion 90, and a bottom portion 100. Top portion 70 includes first and second surfaces 71A, 71B and a through hole 72 which, as mentioned above, is sized to frictionally receive support member 50. Top portion includes one or more cavities 74 which have a mouth 75. The cavity mouth 75 is located at second surface 71B and the interior projects generally upwardly therefrom. Cavity 74 includes a non-plating zone 76 which will be discussed later. The interior of cavity 74 includes an electrically conductive surface in the form of an electrode 78 with which ends of elongated articles make contact. Electrode 78 is provided with a wire 80 which passes through top portion 70 and through an extension 88 which projects from first surface 71A of top portion 70. The end of wire 80 is conventionally attached to a power terminal and will not be discussed. When top portion 70 includes multiple cavities, the electrodes 80 are interconnected, for example, by providing top portion 70 with internal wiring (not shown).

The upper part of cavity 74 is provided with a passage 82 which is in communication with a manifold 84, which, in turn, is in communication with a conduit 86. Manifold 84 communicates with other cavities 74 so that pressure within the cavities may be equalized. Conduit 86, which extends through extension 88, may be connected to a fluid or gas source in a conventional manner (not shown).

Proceeding toward the second end 54 of support member 50 is middle portion 90. Middle portion 90 includes a through hole 92 which receives support member 50. Middle portion 90 also includes an aperture or apertures 94 which are spaced from, and in registry with cavity 74 of top portion 70. Middle portion is spaced from top portion 70 by a distance which is dependent upon the length of a group of elongated articles to be plated. For this reason, support member 50 is provided with adjustment elements 56 along the length thereof, the adjustment elements 56 interacting with middle portion 90 so that the distance between middle portion 90 and top portion 70 may be varied. Although the adjustment elements depicted are protrusions, it is understood that they may take other forms, such as, for example, spring detents, threads, bayonet connections, or the like.

Proceeding past middle portion 90 toward second end 54 of support member 50 is bottom portion 100. Bottom portion 100 includes a through hole 102 which receives support member 50 and is positionable adjacent second end 54 of support member 50. Bottom portion 100 has an article support surface 104 which may be optionally provided with a fence or fences 106 (shown in dashed lines) which are spaced from and in registry with aperture 94 of middle portion 90 and cavity 74 of top portion 70. Bottom portion 100 is spaced from middle portion 90 by a distance which is dependent upon the length of a group of elongated articles to be plated, and may be adjusted along support member 50 in a manner similar to middle portion 90.

Figure 8:
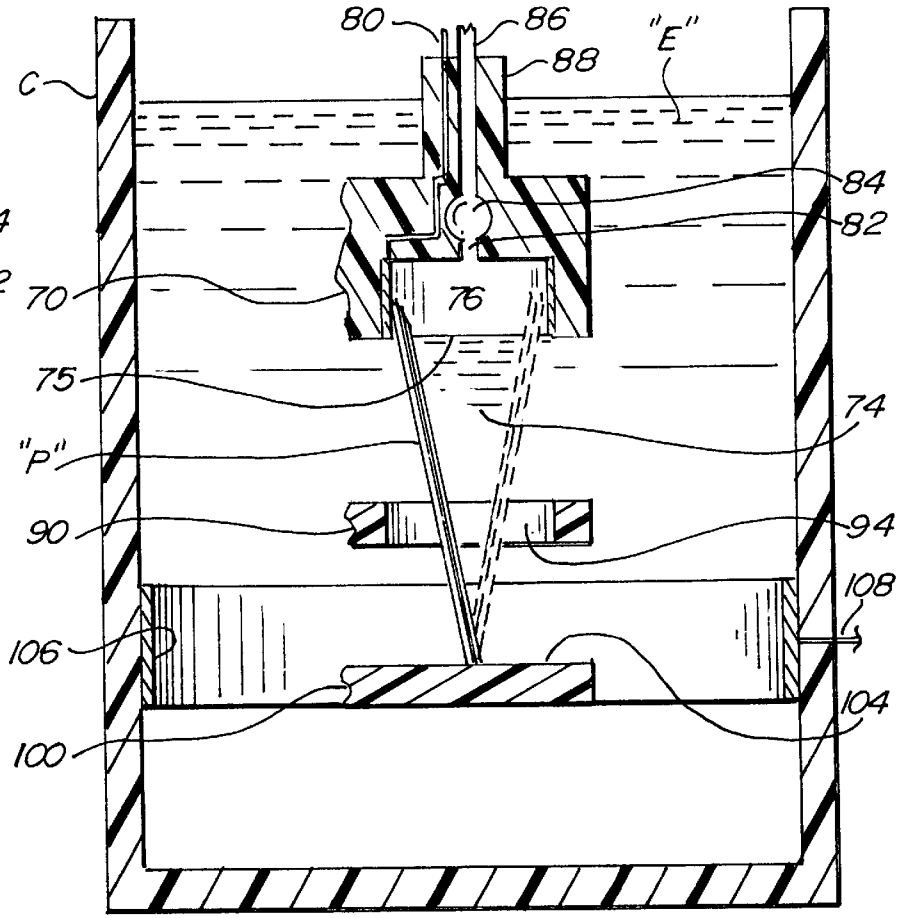
FIG. 8 is a partial, detailed, cross-sectional view of the fixture depicted in FIG. 7, showing the juxtaposition of a plurality of elongated articles to be plated as they are held by the fixture and also showing the plating position of the fixture within a container of electrolytic fluid.

Referring to FIG. 8, a portion of plating portion 60 with a group of elongated articles, such as test probes "P" is depicted in a container "C" containing an electrolyte "E." When plating portion 60 is placed into container C, cavity 74 forms a non-plating zone 76. Non-plating zone 76 is formed by closing of conduit 86, so that cavity 74 acts like an inverted cup and prevents electrolyte "E" from filling cavity 74. During the plating process, cavity 74 tends to collect outgasses and maintain the non-plating zone 76. When the fixture is agitated to facilitate plating, such replenishing of the cavity by outgassing may be overshadowed by sloshing within the cavity itself, thus reducing the size of the non-plating zone 76. To alleviate this potential problem, cavity 74 may be provided with a non-electrolytic gas or fluid under pressure to the extent that excess non-electrolytic fluid exits the mouth 75 of cavity 74.

As can be seen, ends of elongated articles P project into non-plating zone 76. The bodies of the elongated articles P pass through apertures 94 of middle portion 90 and the other ends of the elongated articles P come into contact with article support surface 104 of bottom portion 100. Note that the ends of the elongated articles P, which project into non-plating zone 76 are in electrical contact with each other and adjacent electrode 78. Thus, as a potential is supplied to electrode 78, the elongated articles P, by virtue of their electrical contact with the electrode and with each other, are charged to that same potential.

As the elongated articles P shift in response to motion of the fixture (shown in dashed lines), electrical contact is maintained between the elongated articles P and electrode 78. During the shifting, the bodies of the elongated articles move with respect to each other. This exposes the surfaces of the elongated articles to the plating solution and produces a uniform layer of plating on the elongated articles. Additionally, this fixture and method of plating is particularly suited to plating large batches or groups of articles, numbering in the hundreds or thousands.

As the elongated articles P shift in response to movement of the fixture, their movement relative to article support surface 104 of bottom support 100 may cause the ends of the elongated articles to move out of the non-plating zone 76 and out of cavity 74 itself. Additional guidance and constraint is provided by aperture 94 of middle portion 90, which is in registry with cavity 74. Although middle portion 90 may be positioned anywhere between and adjacent to top portion 70 and bottom portion 100, the preferred position is where the middle portion is closer to bottom portion 100.

During the plating process, a potential on wires 80, 108 causes interaction between electrode 78 and electrode 106 in a conventional manner and will not be discussed.

Figure 9:
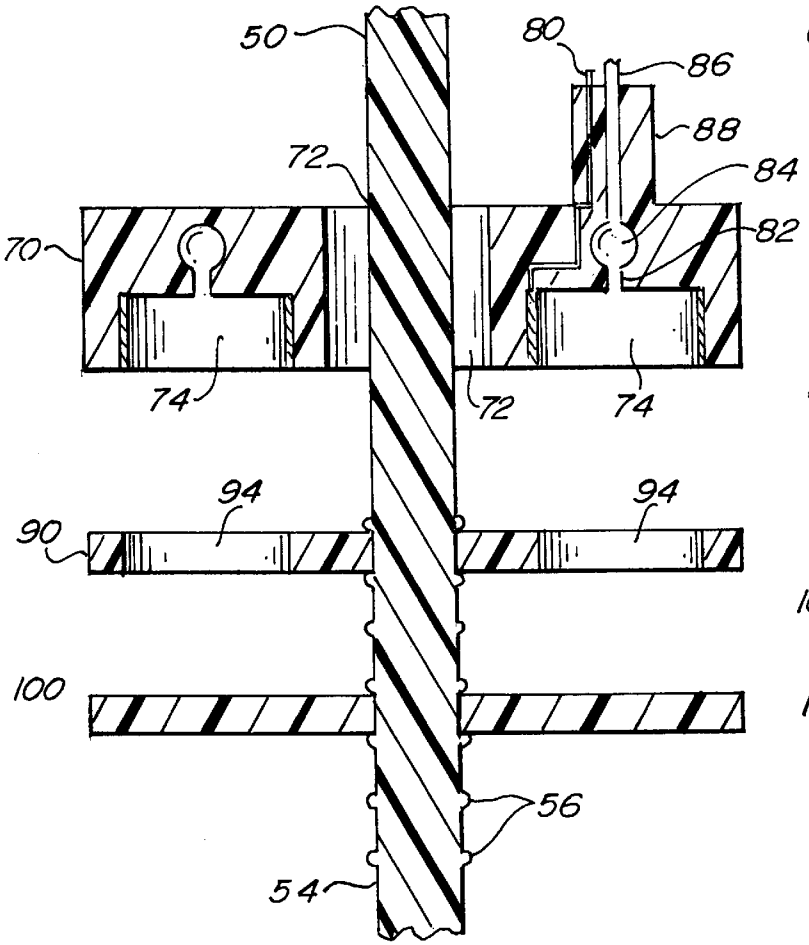
FIG. 9 is partial, detailed, cross-sectional view of a second embodiment of the fixture depicted in FIG. 7, where a top portion may move laterally with respect to a support member.

In an alternative embodiment of the plating portion of FIG. 7 and FIG. 9, the through hole 72 of top portion 70 has been enlarged so that top portion 70 may move independently from support member 50 onto which middle portion 70 and bottom portion 100 are attached. With this embodiment, support member 50 is preferably stationary, while top portion 70 moves. Motion can be imparted by attaching extension 88 to an appropriate motive source (not shown). It is also envisioned, in yet another embodiment, that the middle portion be able to move relative to top and bottom portions.

The present invention may be embodied in other specific forms without departing from the spirit or essential attributes thereof; and it is, therefore, desired that the present embodiment be considered in all respects as illustrative and not restrictive, reference being made to the appended claims rather than to the foregoing description to indicate the scope of the invention.

We claim:

1. A plating apparatus for depositing metal on a plurality of elongated articles, the apparatus comprising;

a) a fixture support, the fixture support having an agitation element, the agitation element having an aperture;

b) a driver operatively connected to and capable of moving the agitation element;

c) a fixture, the fixture having a positioning element connectable to the agitation element;

d) a support member, the support member attached to and projecting away from the positioning element, the support member projecting through the aperture of the agitation element;

e) a top portion attached to the support member, the top portion having a cavity configured to receive a plurality of elongated article ends;

f) a bottom portion attached to the support member, the bottom portion spaced apart from the top portion and configured to support a plurality of elongated article ends;

wherein a plurality of elongated articles are retained between the top and bottom portions of the fixture, the fixture is operatively connected to the agitation element, and the agitation element is moved by the driver.

2. A device for plating a plurality of elongated articles having longitudinal axes, the device comprising:

a) a support member having a longitudinal axis;

b) a top portion, the top portion attached to the support member, the top portion having a cavity for receiving upper segments of a plurality of elongated articles, the cavity including an electrically conductive surface; and, c) a bottom portion, the bottom portion attached to the support member, the bottom member spaced from and aligned with the top portion, the bottom portion having an article support surface;

d) the top and bottom portions arranged to loosely retain a plurality of elongated articles wherein the lower segments of a plurality of elongated articles are supported by the article support surface and the upper segments of the plurality of a elongated articles interact with the electrically conductive surface as the longitudinal axes of the elongated articles shift in response to movement of the device.

3. The device of claim 2, further comprising a middle portion, the middle portion attached to the support member, the middle portion spaced between and aligned with the top portion and the bottom portion, the middle portion having an aperture in registry with the cavity.

4. The device of claim 3, wherein the middle portion is positionable relative to the top portion.

5. The device of claim 2, wherein the bottom portion is positionable relative to the top portion.

6. The device of claim 2, wherein the cavity includes a non-plating zone.

7. The device of claim 2, wherein the top portion includes a passage through which fluid may be introduced into said cavity.

8. The device of claim 7, wherein said fluid is non-electrolytic.

9. The device of claim 7, wherein said non-electrolytic fluid is gaseous.

10. The device of claim 2, wherein the electrical conductive surface comprises an electrode.

11. The device of claim 2, wherein the article support surface of the bottom portion further comprises a fence, the fence in registry with the cavity.

12. A device for plating a plurality of elongated articles having longitudinal axes, the device comprising:

a) a first support member having a longitudinal axis;

b) a second support member having a longitudinal axis;

c) a top portion, the top portion attached to the first support member, the top portion having a cavity for receiving upper segments of a plurality of elongated articles, the cavity including an electrically conductive surface; and, d) a bottom portion, the bottom portion attached to the second support member, the bottom portion spaced from and aligned with the top portion, the bottom portion having an article support surface;

e) the top and bottom portions arranged to loosely retain a plurality of elongated articles wherein the lower segments of a plurality of elongated articles are supported by the article support surface and the upper segments of a plurality of elongated articles interact with the electrically conductive surface as the longitudinal axes of the elongated articles shift in response to movement of the device.

13. The device of claim 12, further comprising a middle portion, the middle portion attached to the second support member, the middle portion spaced between and aligned with the top portion and the bottom portion, the middle portion having an aperture in registry with the cavity.

14. The device of claim 13, wherein the middle portion is positionable relative to the top portion.

15. The device of claim 12, wherein the first and second support members are movable relative to each other.

16. The device of claim 12, wherein the top portion includes a passage through which fluid may be introduced into said cavity.

17. A fixture support for use with a fixture in a plating apparatus, the fixture comprising:

a) a base, the base having a support surface and a first aperture;

b) an agitation element, the agitation element adjacent to and movable with respect to the base, the agitation element having a second aperture in registry with the first aperture of the base, the first and second apertures configured to admit passage of a plating portion of a fixture; and, c) a plurality of retainers, the plurality of retainers movably connecting the agitation element to the base to allow motion therebetween.

18. The fixture support of claim 17, wherein the plurality of retainers are spring elements.

19. The fixture support of claim 17, further comprising friction reducing elements, the friction reducing elements interspersed between the base and the agitation element.

20. The fixture support of claim 19, wherein the friction reducing elements comprise low friction material.

21. The fixture support of claim 17, wherein the agitation element further comprises a plurality of index pins, the index pins configured to be received by through holes in a support portion of a fixture.

22. The fixture support of claim 17, further comprising a driver, the driver movingly connected to the agitation element to provide predetermined motions thereto.

23. A method of partially plating a plurality of elongated articles, the method comprising the steps of:

a) providing a device with a top portion having a cavity with an electrically conductive surface and a bottom portion;

b) placing a plurality of elongated articles between a top portion and the bottom portion of the device so that upper segments of the elongated articles project into the cavity and lower segments are in contact with the bottom portion;

c) immersing the device and the elongated articles into an electrolytic solution; and d) plating the elongated articles.

24. The method of claim 23, wherein the step of plating further comprises the step of moving the device thereby causing the elongated articles to shift position within the cavity.

25. The method of claim 24, wherein the step of moving the device comprises the step of providing reciprocal motion to the device.

26. The method of claim 25, wherein the step of moving the device comprises the step of providing orbital motion to the device.

27. The method of claim 23, further comprising the step of:

introducing a non-conductive fluid into the cavity during the step of plating the elongated articles.

* * * * *